US005350969A

United States Patent [19]

Gattuso

[11] Patent Number: 5,350,969

[45] Date of Patent: Sep. 27, 1994

[54] CATHODE HEATER AND CATHODE ASSEMBLY FOR MICROWAVE POWER TUBES

[75] Inventor: Todd R. Gattuso, Boston, Mass.

[73] Assignee: Litton Systems, Inc., Beverly Hills, Calif.

[21] Appl. No.: 802,076

[22] Filed: Dec. 3, 1991

[51] Int. Cl.[5] ..... H01J 29/04; H01J 1/22

[52] U.S. Cl. ..... 313/446; 313/340

[58] Field of Search ..... 313/411, 446, 450, 340, 313/453, 454

[56] References Cited

U.S. PATENT DOCUMENTS 3,753,025 8/1973 van Stratum et al. ..... 313/340 X 3,803,441 4/1974 Ohsawa et al. ..... 313/340

4,053,807 10/1977 Aozuka et al. ..... 313/340 X

*Primary Examiner*—Sandra L. O'Shea

*Attorney, Agent, or Firm*—Elliott N. Kramsky

[57] ABSTRACT

A cathode heater includes a patterned conductor embedded within a dielectric substrate. The ceramic substrate has a pair of conductors over the respective surfaces thereof to provide electrical contact for the heater. To assemble the substrates having the conductors, the substrates and printed conductive patterns are fired to provide a composite multi-layer ceramic heater which can be used to heat cathode electrodes in microwave tubes such as travelling wave tubes.

8 Claims, 3 Drawing Sheets

CATHODE HEATER AND CATHODE ASSEMBLY FOR MICROWAVE POWER TUBES

BACKGROUND OF THE INVENTION

This invention relates generally to electronic devices that use thermionic emission of electrons and, more particularly, to heater assemblies for heating cathodes to provide the thermionically emitted electrons.

As it is known in the art, vacuum devices such as travelling wave tubes and other microwave devices generally include a cathode which is heated to produce thermionically emitted electrons. Generally, the cathode is indirectly heated by use of a heater assembly which houses a filament. A current is supplied to the filament to raise the temperature of the filament to a temperature in the range of at least 900° C. to 1200° C. The filament of the heater assembly provides thermal energy required to raise the temperature of the cathode electrode to produce sufficient electron emission from the cathode to power the tube.

The heater assembly generally includes a filament wire which is coiled about a region and is maintained in a position relative to the cathode throughout the operating life of the microwave tube. One common approach to providing such heater assemblies is to provide a coiled filament wire supported by a dielectric potting. Generally, the dielectric used for the potting must be a relatively refractory material such as a ceramic in order to withstand the relatively high temperatures typically provided by the filament. Since the thermal transfer properties between the heater filament and the cathode are a critical characteristic to determine overall thermionic emission of electrons, the physical arrangement the heater and the cathode must remain substantially constant over the operating life of the tube. Any variation in the position of the heater filament with respect to the cathode will cause a concomitant change in the temperature of the emitting surface of the cathode and thus a change in the rate of electron emission from the surface of the cathode. Electron emission from such a surface is very sensitive to temperature variations.

Further, the cathode heater assemblies are subject to rapid changes in temperature which can cause failure of the assemblies by cracking of the potting material. Moreover, in many applications of these tubes, such as in airborne applications, the tubes are subjected to high levels mechanical vibration and mechanical shock which likewise can have adverse effects on the potting materials and can cause failure of the heater.

Generally, techniques used to provide suitable pottings for these tubes rely upon encapsulation of the coiled filament which often provide pottings having less than 80% of theoretical density of the potting material and, furthermore, often provide pottings having voids or spaces in the potting which can act as fracture centers during subsequent operation of the tube. The potting approach is also relatively expensive since a significant amount of manual labor, as well as reworking of the potting assembly is often required to provide a useable filament heater.

SUMMARY OF THE INVENTION

In accordance with the present invention, a heater assembly for a cathode includes a dielectric substrate and a patterned strip conductor embedded in said dielectric substrate. The dielectric substrate has a pair of holes disposed therethrough with each of the holes being filled with an electrically conductive material to provide first and second backside connections to first and second end portions of the patterned strip conductor. In one embodiment, a first electrical contact is disposed over a first surface of said substrate and a second electrical contact is disposed over a second surface of said substrate with the conductive material provided through said substrate disposed in contact between the first and second electrodes and the selective end portions of the patterned strip conductor. In an alternate embodiment, first and second electrical contacts are disposed over a first surface of said substrate. Holes having electrically conductive deposits are disposed through said substrate to make electrical contact between the first and second end portions of the patterned strip conductor and a corresponding first and second spaced electrical contacts disposed over the first surface of the substrate. This provides a substrate heater having a pair of electrical leads provided from a common surface of the substrate. With such an arrangement, a self-supported heater that can be easily mass produced by conductor printing and ceramic packaging techniques is provided. Since standard processing of ceramic substrates may be used to provide the cathode heater assembly, the assembly can be mass produced at relatively low costs. Furthermore, since the patterned strip conductor which provides the heater filament for the cathode heater is in a single plane, the patterned conductor providing the complete heating member may be disposed closer to a cathode electrode. This permits the assembly to operate at a lower temperature for a given electron emission level from the cathode thus improving the lifetime of the cathode heater and cathode. Further, the distance between the conductor and a cathode electrode is fixed and will be substantially invariant with operation of the cathode heater (since the patterned strip conductor is embedded in a ceramic substrate). Moreover, the problems of the potting material having voids or imperfections is also eliminated with this arrangement.

In accordance with a further aspect of the present invention, a cathode assembly comprises a cathode electrode having a surface which emits electrons when heated and a cathode heater. The cathode heater includes a dielectric and a patterned strip conductor embedded in said dielectric. First and second conductors are provided over opposing surfaces of said dielectric and are electrically coupled to respective first and second ends of said embedded, patterned strip conductor. Further, one of said electrodes is coupled to the cathode electrode providing a first terminal of the cathode assembly and the second one of said electrodes provides a second terminal for the cathode assembly. With this particular arrangement, an integral cathode heater assembly is provided. Since the heater electrode is disposed in a single plane, the electrode is disposed closer to the cathode thus potentially permitting lower heater temperature operation for a given electron emission level from the cathode. Further, the filament plane of the conductor of the heater is substantially fixed in relation to the cathode thus reducing variations in emission as often occurs over the operating lifetime of prior cathode and heater assemblies. Further still, this arrangement provides a cathode having an integral heater having a dielectric support which is free from voids and other defects in material which supports and spaces the heater from the cathode.

In accordance with a further aspect of the present invention, a method of fabricating a cathode heater assembly comprises the steps of providing a dielectric substrate having a first aperture disposed therethrough, filling said aperture with a conductive material, providing a patterned conductor over a first surface of said dielectric substrate with said patterned conductor having an end portion disposed over, and in contact with the conductive material in said aperture, providing a dielectric layer over said dielectric substrate and patterned conductor with said layer having an aperture exposing a second underlying end portion of said patterned conductor, filling said aperture in said layer with a conductive material, providing a pair of conductive layers over opposing surfaces of said dielectric layer and said dielectric substrate, and consolidating said dielectric layer and dielectric substrate to provide a substantially monolithic dielectric embedding said patterned strip conductor. With this particular arrangement, a self-supported heater having a filament disposed in a single plane and embedded in a dielectric is provided. The techniques of screen printing and ceramic processing are used to easily mass produce such heaters at relatively low cost with a reduction in the manual steps and reworking of heaters as often encountered with the prior potting approach.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
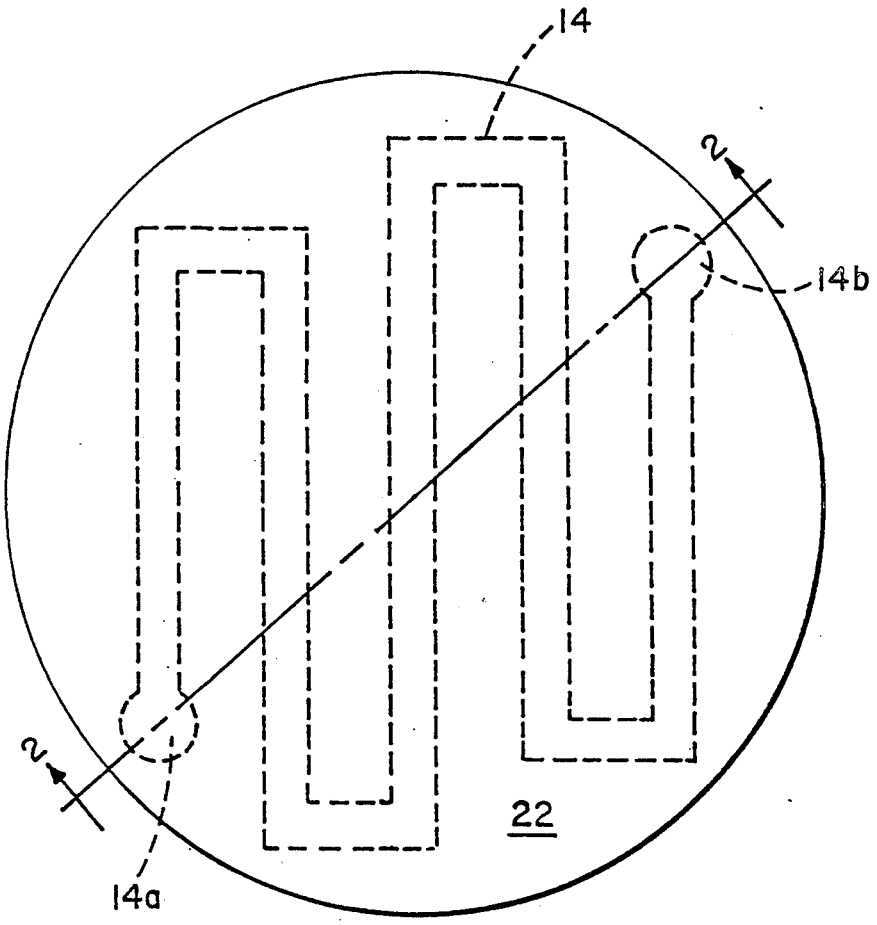
FIG. 1 is a plan view of a cathode heater assembly in accordance with the present invention.
Figure 2:
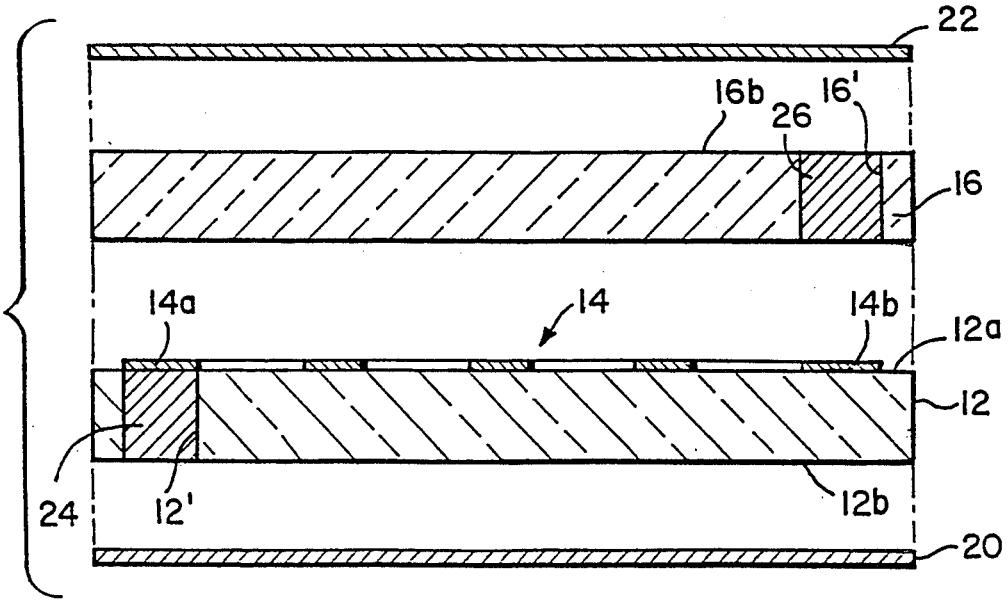
FIG. 2 is an exploded cross-sectional view taken along lines 2—2 of FIG. 1.
Figure 2A:
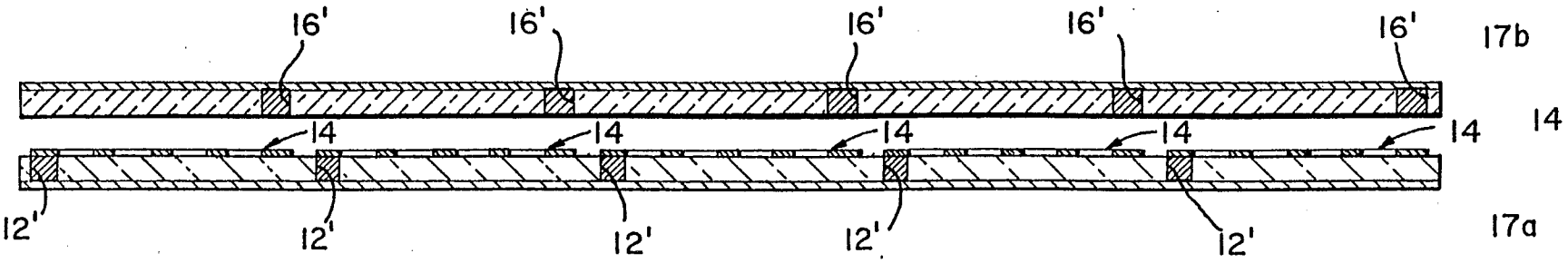
FIG. 2A is a cross-sectional view of a plurality of cathode heater elements during an intermediate stage of fabrication.

Referring now to FIGS. 1, 2, and 2A, a cathode heater 10 is shown to include a first "green state" dielectric layer or substrate 12 having a through hole 12' disposed therein using any conventional technique such as punching or drilling, for example, and having disposed over a first surface **12*a* thereof a patterned strip conductor 14. In general, patterned strip conductor 14** is a meandered strip conductor pattern formed using conventional patterning techniques and is typically provided in a predetermined pattern to provide a conductor having a requisite resistance characteristic.

As, for example, shown in FIG. 1 here the conductor pattern 14 is provided as a meandered strip conductor between a pair of end portions **14*a*, 14*b* which are used to provide contact to electrodes, as will be described hereinafter. The layer or substrate 12 further has a conductive deposit 24 disposed within through hole 12'. Conductive deposit 24 is disposed to couple strip conductor portion 14*a* to a bottom surface of dielectric layer 12 in order to provide a first electrical connection to the patterned strip conductor 14**. Alternative connection means could be used. For example, "wrap around" conductors sometimes provided on semiconductor substrates could be used. Here the holes with conductive deposits are used due to their suitability and expediency.

Figure 3:
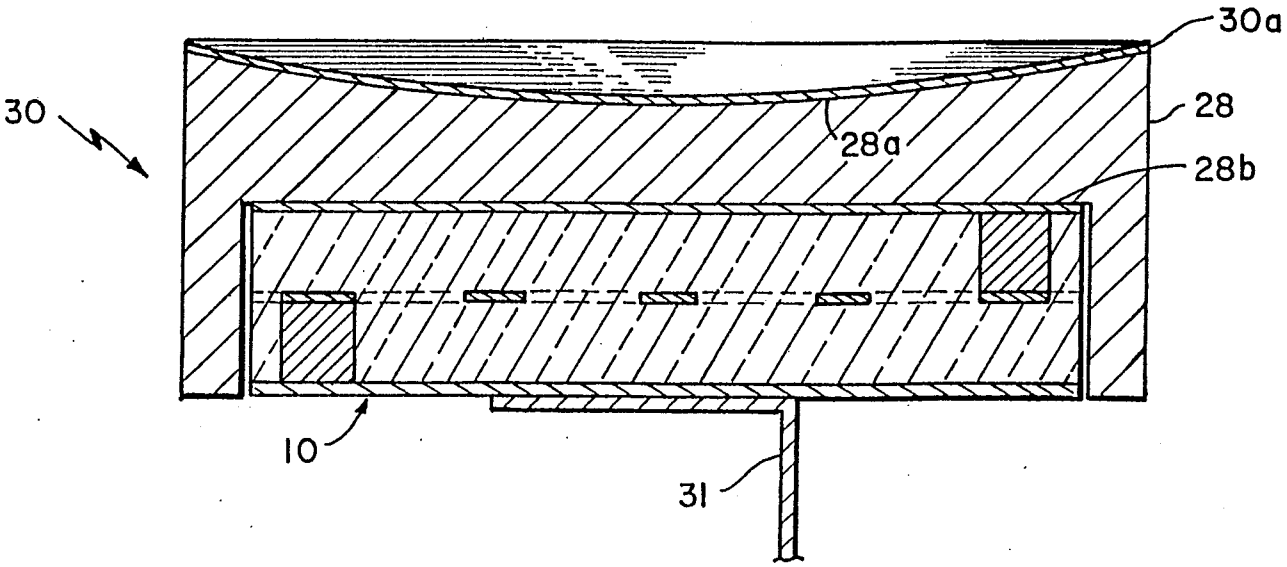
FIG. 3 is a cross-sectional view showing the cathode heater assembly of FIGS. 1 and 2 incorporated into a cathode electrode in accordance with the present invention.

The heater assembly 10 further includes a second dielectric layer 16 disposed over the patterned strip conductor **14*a* having a through hole 16' with a conductive deposit 26 disposed therein as shown. Disposed over second surfaces 12*b* and 16*b*, respectively, of layers 12 and 16 are conductors 20 and 22, as shown. The cathode heater assembly 10 when assembled together, as shown in FIG. 3, provides an integral heater for a cathode electrode. The cathode heater assembly 10** is fabricated using conventional techniques commonly used in the ceramic packaging industry.

For example, so-called tape cast ceramic green sheets **17*a*, 17*b* (FIG. 2A) commonly used to provide ceramic packages can be prepunched with holes 12', 16' for respective ones of substrates 12 and 16 which will be cut from the "green state" tape cast sheets 17*a*, 17*b*. Each of the holes 12', 16' can be screen printed or otherwise filled with a tungsten/ceramic composite metallization paste. The tungsten/ceramic composite metallization paste is also screen printed over surfaces 17*a'*, 17*b'* (corresponding to surfaces 12*b*, 16*b* of substrates 12, 16 of FIG. 2) to provide the metallizations 20 and 22, as shown. The paste used to fill the holes can be different from that used on the horizontal surfaces. Over one of the tape-cast sheets is then screen printed the meandered patterned strip conductor 14 here using the same tungsten/ceramic composite metallization paste. After printing of numerous ones of said patterns on one of the pair of ceramic green sheets 17*a*, 17*b* (as shown in FIG. 2A), the sheets 17*a*, 17*b* are aligned such that the punch holes in each one of the sheets line up with the end contact portions 14*a* and 14*b* of the patterned conductive layer 14 (FIGS. 2, 2A). The sheets are then laminated together by application of heat and pressure. Thereafter the laminated ceramic green sheets are cut out or punched out in accordance with the inner diameters of the cathode buttons (FIG. 3**) and the individual elements are fired in a reducing atmosphere to sinter the elements together.

Preferred materials for substrates 12 and 16 include aluminum oxide (alumina), beryllium oxide, and aluminum nitride. In general, any refractory ceramic which has a relatively high thermal conductivity may be used. Moreover, suitable materials for patterned metal layer 14, deposits 24, 26, and conductors 20, 22 include compositions of tungsten or molybdenum for example although any so-called refractory type of metal including tantalum and rhenium alternatively may be used. In general, the material is selected in accordance with the temperature at which the heater is to be operated, as well as the resistance characteristic required of the heater.

Preferred temperature range for compacting or consolidating the pair of tape cast ceramic green sheets **17*a*, 17*b*** to provide a laminated body include temperatures in the range of 25° C. to 125° C. for the above-mentioned substrate materials. This lamination step used to consolidate the pair of tape cast sheets together provides a body having a density of about 50% of theoretical density. Moreover, pressure is applied to the sheets by a hydraulic press. Lamination can be accomplished with application of uniaxial pressure. Isostatic pressure application also can be used.

Preferred sintering temperatures to sinter individual cut out elements are in the range of 1,300° C. to 1,900° C. for the above substrate materials. This provides the heater assembly 10 with a dielectric having a density of 90% to 99.5% theoretical density embedding patterned strip conductor 14.

It should be kept in mind that during the above-described consolidation and, in particular, during the above-described sintering process that a certain amount of shrinkage of the material will occur. This shrinkage could be anywhere from 12% to 20%. Accordingly, this shrinkage should be taken into consideration when designing particular heater elements to fit within particular cathode assemblies. Typical thicknesses for the substrates 12 and 16 are 0.005 inches to 0.025 inches.

One of the more important specifications of the cathode heater is the resistance characteristic of the filament. This is particularly true in a retrofit application of the heater. In general, it would be required that the filament present a predetermined resistance characteristic to a supply voltage (not shown). Accordingly, in order to achieve the desired resistance characteristic, the sheet resistivity of the metal layer used to provide a conductive pattern 14 after firing of the metal should be ascertained. In accordance with this fired sheet resistivity characteristic, an appropriate length to width ratio of the conductor pattern may then be selected to provide the desired resistance. Thus, assuming the fired sheet resistivity is 15 milliohms per square, then a length to width ratio of 83, would provide a line having a resistance of 1.25 ohms. In general, since the cross-sectional area of the conductive deposits in the through holes is many times larger than the cross-sectional area of the patterned strip conductor 14, the resistance of these elements can be ignored in the overall resistance calculation.

Referring now to FIG. 3, the cathode heater 10 (FIGS. 1, 2) is shown attached to a "cathode button 28." Here the cathode button 28 is comprised of impregnated porous tungsten. The cathode heater 10 is brazed to the back surface **28*b* of cathode support 28 using a suitable braze such as a tungsten-nickel alloy. The cathode heater 10 is shown to include a conductor 31 brazed to the conductor pattern 20. Thus, lead 31 and cathode body 28 provide a pair of terminals for the cathode heater and thus the cathode is disposed at the same potential as one of the electrodes of the cathode heater 10. Typically, that potential is a ground potential. An opposing surface 28*a* of cathode 28 is a cathode emitter surface, here such surface 28*a* has a spherical concave surface shape. Surface 28*a* is here coated with a material which increases thermal emission by lowering the work function of the material of surface 28*a*. For example, a layer 30*a* of a material such as osmium may be coated over surface 28*a*. Moreover, the tungsten cathode 28** is impregnated with osmium to lower the work function of the tungsten metal and thus improve the thermionic emission properties thereof.

With the above-described heater assembly, a patterned strip conductor supported in a single plane is embedded within a dielectric substrate. In particular, as described above, the patterned strip conductor is disposed between a pair of substrates 12, 16 which are then fired together to sinter the ceramic material of the substrates and thus provide a substantially monolithic dielectric which encapsulates the flat conductor disposed in a common plane. That is, unlike the prior approaches where the coiled filament is coiled about a region and thus disposed in many planes and is hence nonplanar, the filament, patterned strip conductor described above is disposed substantially in a single plane and is thus planar.

Figure 4:
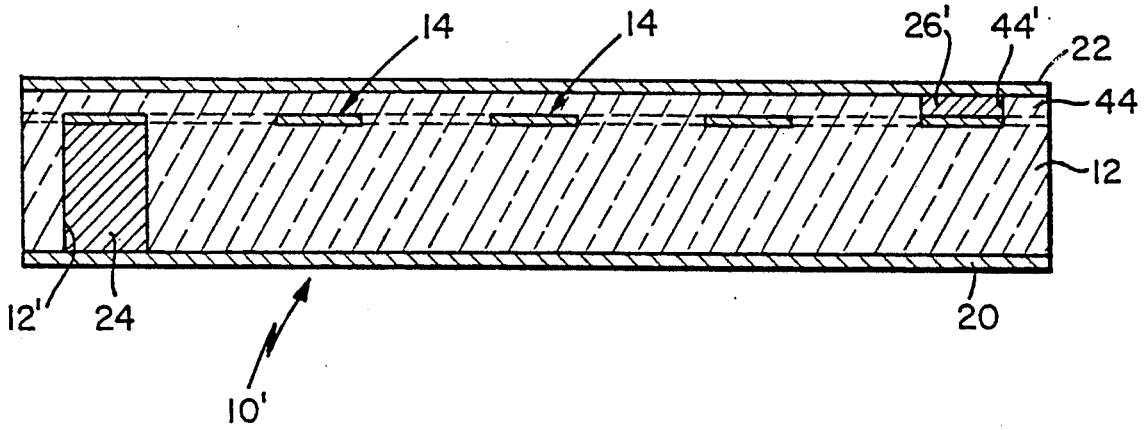
FIG. 4 is a cross-sectional view of an alternate embodiment of a cathode heater.

Referring now to FIG. 4, an alternative embodiment of the cathode heater 10' (after sintering) is shown to include a first dielectric substrate or layer 12 having through hole 12' disposed therein using any conventional technique such as punching or drilling as discussed in conjunction with FIGS. 1 and 2. Moreover, the patterned strip conductor 14 is disposed over a first surface of substrate 12, as also discussed in conjunction with FIGS. 1 and 2. Here, however, rather than providing a second substrate also comprised of a tape cast ceramic sheet, as discussed in conjunction with FIGS. 1 and 2, a dielectric layer 44 is likewise screen printed over substrate 12 and the dielectric is patterned to provide a hole 44' exposing one of the end portions of the patterned strip conductor 14. The thickness of layer 44 is generally in the range of 0.002 inches to 0.005 inches. Layer 44 may be applied in a single printing step or multiple steps may be used to provide layer 44 having the desired thickness. The conductors 20, 22, deposit 24, and a deposit 26' are likewise provided by screen printing, as generally explained in conjunction with FIGS. 1–2A. This arrangement is then sintered using the techniques generally described in conjunction with FIGS. 1 and 2 to likewise provide a monolithic heater assembly 10' here, however, having a relatively thin dielectric layer over the patterned strip conductor rather than the thicker dielectric layer described in conjunction for the heater 10 of FIGS. 1 and 2. In general, lamination is not required when the second dielectric is screen printed over the first substrate 12. This arrangement may provide further improvements in heat transfer to a cathode button when provided in the cathode assembly as shown in conjunction with FIG. 3.

Figure 5:
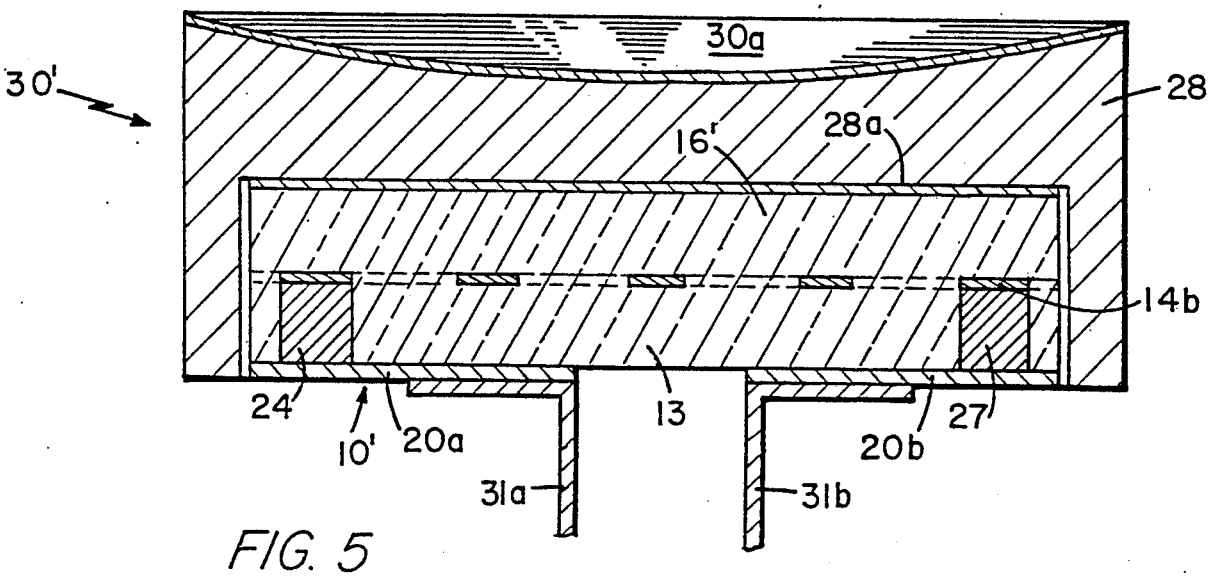
FIG. 5 is a cross-sectional view showing an alternate embodiment of a cathode heater incorporated into a cathode electrode.

Referring now to FIG. 5, a further alternate embodiment of a cathode and heater is shown to include a cathode heater 10' generally fabricated as discussed in conjunction with FIG. 1, here, however, having a substrate 13 having a pair of apertures (not numbered) with said apertures being filled with conductive deposits 24 and 27, as shown. Such deposits provide corresponding electrical contact to end portions of the strip conductor pattern 14. The heater 10' further includes a pair of dielectrically spaced, conductive regions **20*a*, 20*b* disposed over the same surface of substrate 13. Here a pair of leads 31*a*, 31*b* are soldered or brazed to the respective conductive regions 20*a* and 20*b*** to provide a cathode heater having a pair of electrical contacts provided from the back of the heater element. Thus, with this embodiment the cathode can be electrically connected independent the heater element.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A cathode heater, comprising:

a dielectric;

a patterned strip conductor embedded in said dielectric;

first and second conductors disposed over opposing surfaces of said dielectric; and means for coupling the first one of said conductors to a first portion of said patterned strip conductor, and for coupling said second conductor to a second, different portion of said patterned strip conductor.

2. The cathode heater, as recited in claim 1, wherein said means for coupling the first and second conductors includes a pair of conductive deposits disposed in a hole provided in said dielectric.

3. The cathode heater, as recited in claim 2, wherein said patterned strip conductor is comprised of a refractory metal.

4. The cathode heater, as recited in claim 2, wherein the strip conductor is comprised of a metal selected from the group consisting of tantalum, rhenium, tungsten, and molybdenum.

5. A cathode assembly, comprising:

an electrode member having a first surface with a concave depression and a second opposing surface;

a cathode heater assembly coupled to said second surface of said electrode, said cathode heater assembly comprising:

a dielectric;

a patterned strip conductor embedded within said dielectric substrate;

first and second conductors disposed over opposing surfaces of said dielectric; and means for coupling the first one of said conductors to a first portion of said patterned strip conductor and said second conductor to a second, different portion of said patterned strip conductor.

6. The cathode heater, as recited in claim 5, wherein said means for coupling the first and second conductors includes a pair of conductive deposits disposed in respective holes provided in said dielectric.

7. The cathode heater, as recited in claim 6, wherein said patterned strip conductor is comprised of a refractory metal.

8. The cathode heater, as recited in claim 6, wherein the strip conductor is comprised of a metal selected from the group consisting of tantalum, rhenium, tungsten, and molybdenum.

* * * * *